United States Patent [19]

Deverrewaere

[11] 4,193,659

[45] Mar. 18, 1980

[54] DEVICE FOR CONNECTING AN AUTOMOBILE HEADLAMP TO A PRINTED CIRCUIT

[75] Inventor: Alain Deverrewaere, La Varenne, France

[73] Assignee: Cibie Projecteurs, Bobigny, France

[21] Appl. No.: 948,562

[22] Filed: Oct. 4, 1978

[30] Foreign Application Priority Data

Oct. 12, 1977 [FR] France ..... 77 30698

[51] Int. Cl.[2] ..... H01R 13/54

[52] U.S. Cl. ..... 339/17 D; 339/244 R

[58] Field of Search ..... 339/17 D, 176 MF, 176 MP, 339/244 R

[56] References Cited

U.S. PATENT DOCUMENTS

| | | | |
|---|---|---|---|
| 3,701,071 | 10/1972 | Landman | 339/176 MP |
| 3,813,636 | 5/1974 | Mason | 339/244 R |
| 4,065,198 | 12/1977 | Jordan | 339/17 D |

FOREIGN PATENT DOCUMENTS

| | | | |
|---|---|---|---|
| 2513635 | 10/1975 | Fed. Rep. of Germany | 339/176 MF |

*Primary Examiner*—Joseph H. McGlynn

[57] ABSTRACT

The invention relates to a device for ensuring the mechanical and electrical connection of an automobile headlamp, comprising at least one flat connecting pin, to a flexible printed supply circuit, said device comprising, for each pin of the lamp to be connected, a clip constituted by two homologous parts connected by a hinge and adapted to cooperate with each other along a plane of tightening, these two homologous parts comprising on their inner face means for positioning the pin inside the clip, means for retaining the printed circuit inside the clip, means for closing the clip ensuring its tightening so that the printed circuit is applied along the whole length of the pin of the lamp. The invention is more particularly applied to all automobile headlamps.

9 Claims, 13 Drawing Figures

DEVICE FOR CONNECTING AN AUTOMOBILE HEADLAMP TO A PRINTED CIRCUIT

Figure 1:
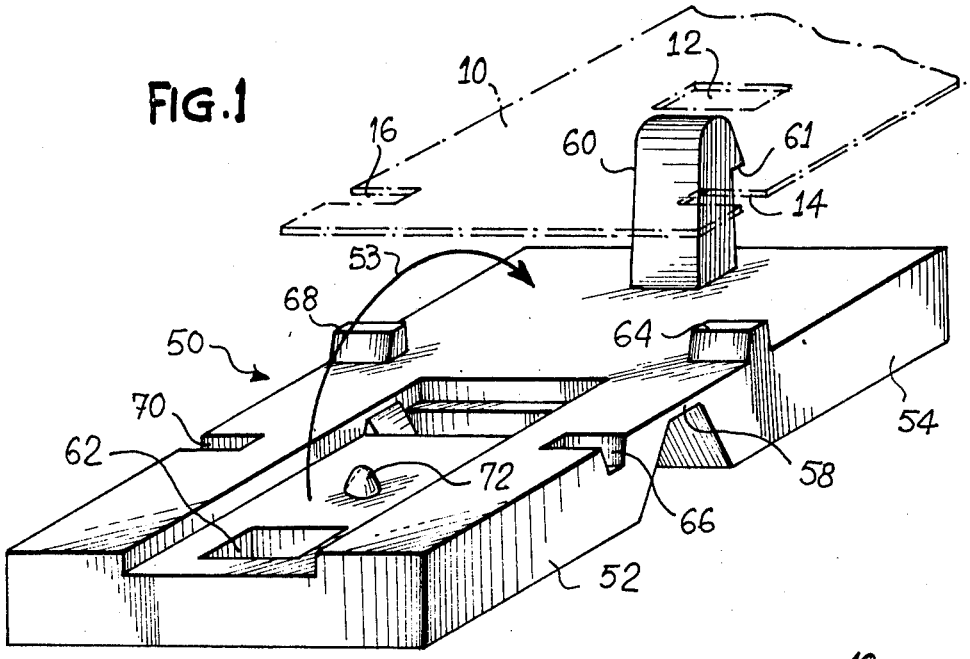

The present invention relates to the electrical connection of printed circuits to automobile headlights.

The use of printed circuits is presently more and more widespread. Moreover, due to their reliability and ease of use, they are particularly well adapted to automobiles where they withstand, better than other components, the vibrations produced by the engine and by the running conditions.

Furthermore, headlight lamps are strictly standardised in their dimensions and electrical connection means. The so-called H1 lamp comprises a flat base forming a flat connection pin. The lamp of type H4 has three connection pins disposed in three different planes.

Up to the present time, it has never been proposed to connect a printed supply circuit directly to an automobile headlight.

The invention is based on the observation that such a direct connection by pressing the printed circuit against the pins of a headlight lamp is possible due to the fact that the printed circuit is sufficiently flexible to adapt itself to the shape of the base of the lamp.

The connecting device according to the invention envisages maintaining the printed circuit against each flat pin of the base of a headlamp by tightening, ensuring both the fixing of the printed circuit and of the lamp.

The device according to the invention thus comprises, for each pin of the lamp to be connected, a clip constituted by two homologous parts connected by a hinge, means for positioning the pin inside the clip, means for retaining the printed circuit inside the clip, and means for closing the clip.

In the case of an H1 lamp, which comprises one pin, the device according to the invention is in the form of a simple one-piece clip of which the bisecting plane is the only plane of tightening and contact of the printed circuit and of the base of the H1 lamp.

In the case of a lamp of type H4, with three pins, the device according to the invention comprises a central body provided with three flaps mounted on hinges, to make three clips in three planes of contact and tightening corresponding to the three pins of the lamp.

In all cases, the tightening of the printed circuit and each pin of the lamp is thus ensured in an elastic clip which ensures therebetween a precise electric contact and which resists the effects of vibration.

According to an important feature of the invention, the clip maintains the circuit in alignment with the pin, said latter being introduced in the clip through a slot made in the hinge thereof.

For each clip, the means for positioning the pin are constituted by male and female reliefs homologous of the reliefs of the pin and cooperating therewith at least in the position of closure of the clip.

The means for retaining the printed circuit are similarly constituted by projecting parts cooperating, at least when the clip is closed, with recesses made in the printed circuit.

The means for closing the clip preferably use the cooperation of a shouldered catch and an orifice, respectively located on each of the homologous parts. In fact, the catch passes through the orifice completely until the shoulder is in abutment, thus preventing the homologous parts from moving away from each other.

Figure 2:
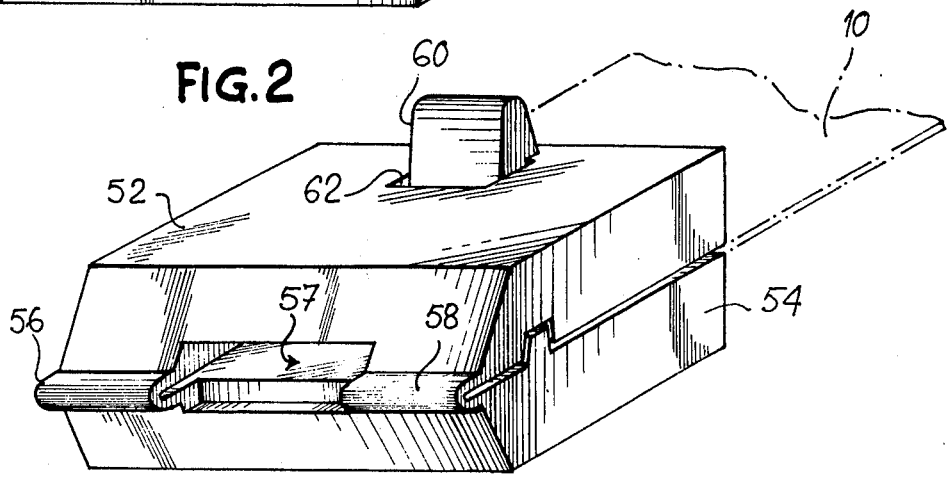
Figure 4:
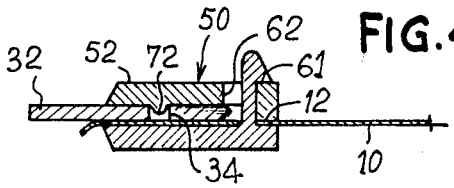
Figure 3:
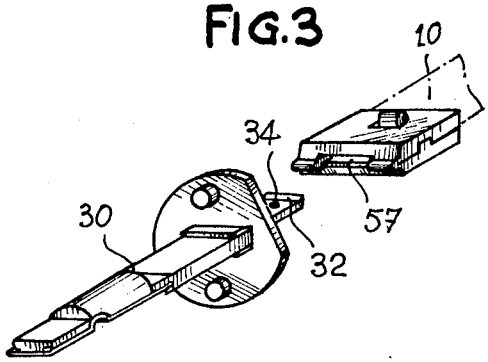
Figure 5:
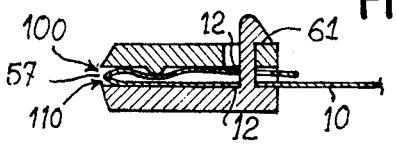
Figure 6:
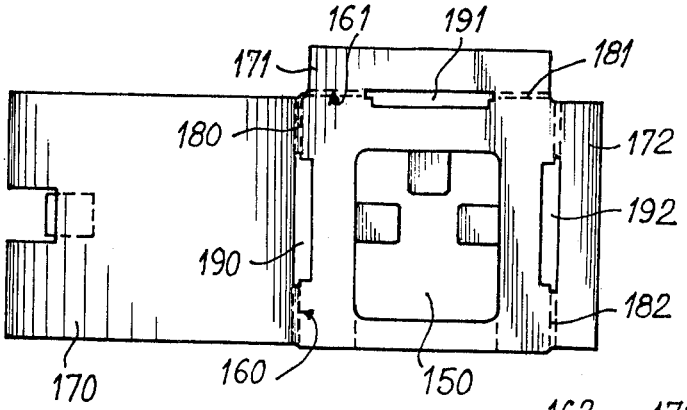
Figure 7:
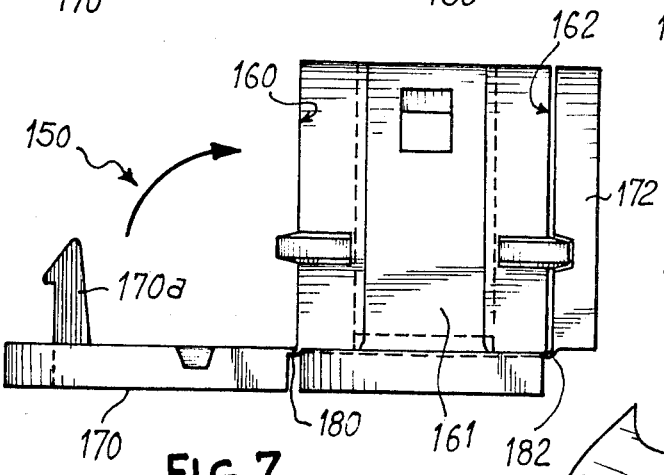
Figure 8:
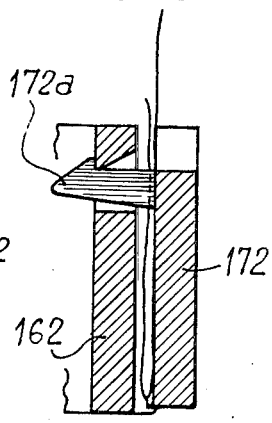
Figure 9:
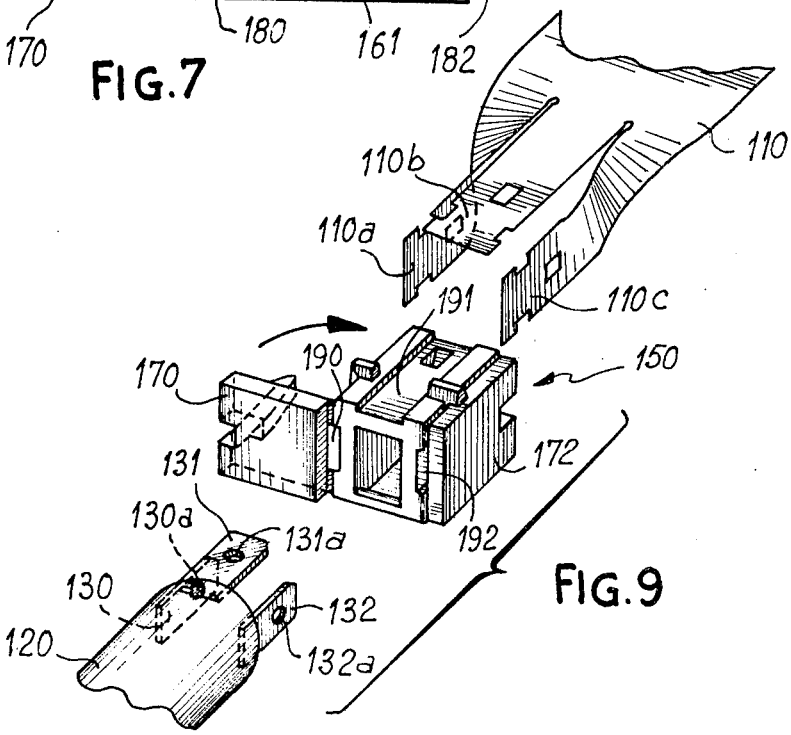
Figure 6A:
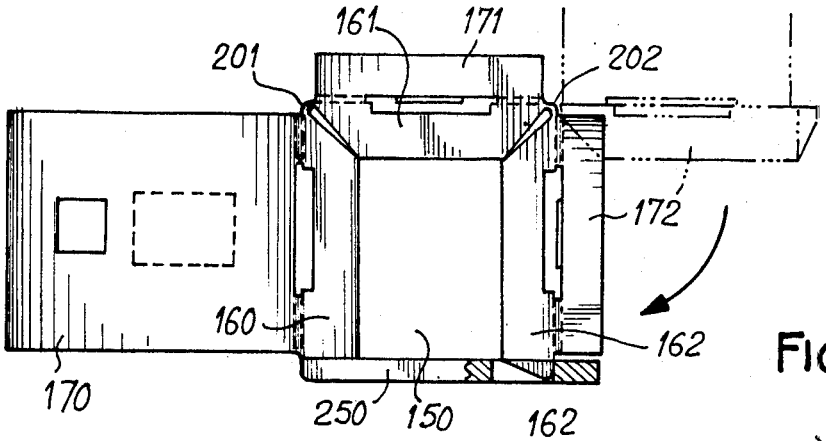
Figure 7A:
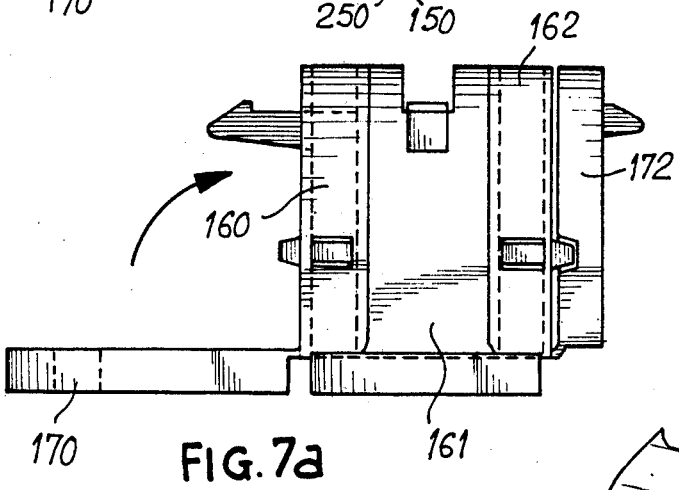
Figure 8A:
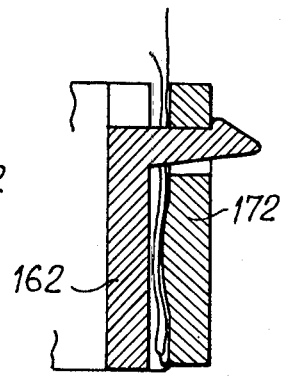
Figure 9A:
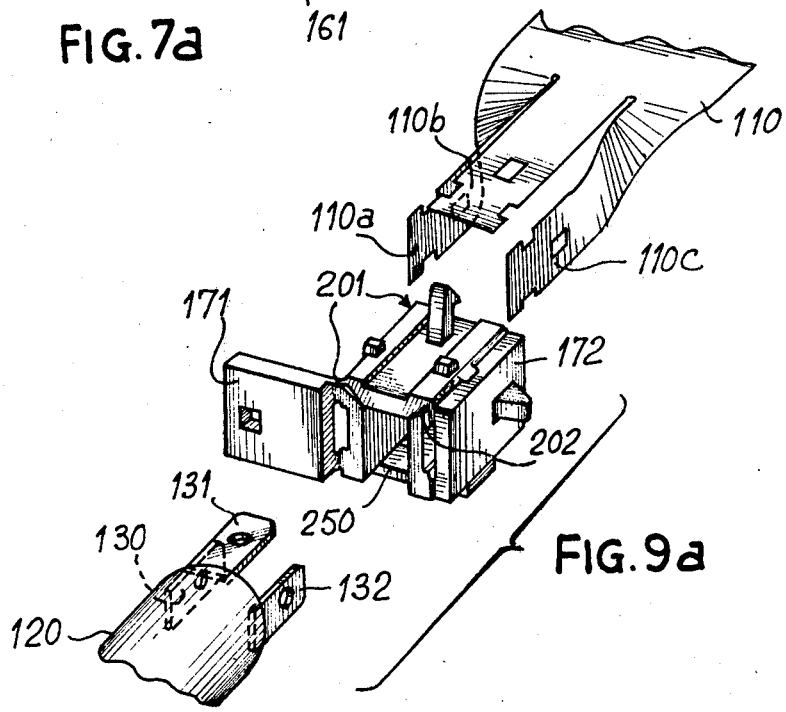

The invention will be more readily understood on reading the following description with reference to the accompanying drawings, in which:

FIGS. 1 to 5 show a connection device for headlamps of type H1, and more precisely:

FIG. 1 shows a view in perspective of this device according to the invention in open position, FIG. 2 shows a view in perspective of the device in closed position, FIG. 3 shows a view in perspective of the positioning of an H1 lamp in the connection device, FIG. 4 shows a view in section along the longitudinal median plane of the connection device connecting the lamp H1 and the printed circuit, and FIG. 5 shows a sectional view similar to the preceding one, in the absence of the lamp H1, the printed circuit being folded, FIGS. 6 et seq. shows devices for connecting a printed circuit to a lamp of type H4, and more precisely FIGS. 6, 7 and 8 illustrate such a device in elevation, in plan view and in transverse section, respectively;

FIG. 9 shows in perspective the assembly of the device of FIGS. 6 to 8 with a lamp H4 and a printed circuit;

FIGS *6a*, *7a*, *8a* and *9a* are similar to FIGS. 6 to 9, in another embodiment.

The connection device for lamp H1 will firstly be described, with reference to FIGS. 1 to 5.

These Figures show a connector 50 serving to connect the pin 32 constituting the base of a lamp H1, 30, to a flexible printed circuit 10 serving to supply the lamp.

The device is in the form of a one-piece case made of moulded plastics material. In FIG. 1, this case is shown in open position. It comprises two homologous parts 52 and 54 foldable against each other in the direction of arrow 53. The two parts 52 and 54 form a clip, being connected together by a hinge constituted by two thin plates 56 and 58 of thickness clearly smaller than that of the homologous parts and consequently constituting a supple zone. The part 54 comprises a shouldered catch 60 adapted to engage in a central recess 12 of the printed circuit and in the corresponding orifice 62 of the homologous part 54. The shoulder 61 abuts on the opposite face of the part 52 so as to constitute a means of closing the device. References 64 and 68 correspond to two bosses on the part 54 adapted to cooperate with the cavities 66 and 70 of part 52. These bosses which are positioned, on closure, in recesses 14 and 16 of the circuit, constitute means for retaining the circuit; other means for retaining the circuit 10 are constituted by the catch 60 which engages in a central recess 12 of the circuit.

The means for positioning the pin of the lamp are constituted by an inner recess in the part 52 adapted to receive the pin 32, and by a lug 72 adapted to penetrate in a standardised orifice 34 made in the pin of the lamp H1.

FIG. 2 shows the device when closed, the printed circuit 10 being gripped between the two homologous parts 52 and 54. The opening 57 between the two thin plates 56 and 58 is intended for the insertion of the pin of the lamp H1.

FIG. 3 clearly shows how the pin 32 of the lamp 30 is introduced in the opening 57. The orifice 34 is adapted to come to the level of lug 72 which thus elastically locks the pin of the lamp.

FIG. 4 clearly shows, in section, the lug 72 inserted in the orifice 34 whilst the shoulder 61 in abutment through the orifice 62 against the upper face of the part 52 ensures the locking of the case 50.

FIG. 5 shows a different way of fixing the printed circuit 10 which is folded inside the case and consequently comprises the recesses 12, 14 and 16 in duplicate. In this case, it is possible to ensure the electric contact with the pin of the lamp by inserting said latter either in the upper part in the direction of arrow 100, or in the lower part of the opening in the direction of arrow 110.

FIGS. 6 to 9 illustrate a second embodiment of the invention for the assembly of a lamp 120 of type H4, and comprising three pins 130, 131 and 132 in three perpendicular planes. These three pins are to be electrically connected to a flexible printed circuit 110.

In this case, the connection device 150 according to the invention is in the form of a cubic block of which three adjacent faces 160, 161 and 162 are adapted to serve as support for each of the three pins 130, 131, 132, respectively. Each of the faces 160, 161, 162 cooperates in the manner of a clip with a pivoting flap 170, 171, 172 pivoted on hinges 180, 181, 182. Each pair such as 160–170, 161–171, 162–172, constitute, as before, a clip adapted to receive and tighten one on the other lamp pin and a printed circuit element.

As before, each of the clips thus constituted comprises means for positioning the pin, means for retaining the printed circuit and closure means. For example, FIG. 7 and FIG. 8 clearly show the closure of a flap (170 or 172) against the homologous element (160, 162) with the aid of closure catches (170*a*, 172*a*).

The means for retaining the circuit, the means for positioning the pins, and the means for closing the clips (160, 170), (161, 171), (162, 172) will not be described in detail as they are similar to what has been described with regard to FIGS. 1 to 5.

To facilitate understanding, the upper flap 171 has not been shown in FIGS. 7, 8 and 9.

The execution of the invention is easy to understand with reference to FIG. 9: the printed circuit 110 is divided at its assembly end into three sections (110*a*, 110*b*, 110*c*) adapted to be connected to the three pins of the lamp.

The flaps 170, 171, 172 being open, the three faces 160, 161, 162 are covered by the three sections 110*a*, 110*b*, 110*c*. The flexibility of the printed circuit 110 allows such an assembly. The flaps are closed, this fully implementing the means for retaining the printed circuit. The hinges 180, 181, 182 of the flaps 170, 171, 172 comprise in their central part a slot 190, 191, 192 for access. It is through these slots that the pins 130, 131, 132 of the lamp are introduced, this implementing the positioning means (in the present case and as beforehand, each pin 130, 131, 132 has its housing and a positioning lug enters each of the openings 130*a*, 131*a*, 132*a* of the different pins).

The device 150 which has just been described is cubic in structure, in the sense that the main body of the device is a hollow cube.

In the second embodiment of FIGS. 6*a*, 7*a*, 8*a* and 9*a*, the structure is substantially identical (and the same general references are employed, particularly for the faces and flaps), but the connection assembly may be flattened and moulded flat, before being put back into shape in its position of use.

The faces 160, 161, 162 are pivoted about hinges 201, 202, and such an assembly is completed by a pivoting lid 250. The whole is moulded flat. In the position of use, the cubic arrangement of the faces 160, 161, 162 is reestablished, the lid 250 forming the complementary face closing the cube.

In all embodiments, the printed circuit is maintained in contact with the pin which supplies it over the whole extent thereof. The use of clips ensuring, when closed, both the grip of the pin and the grip of the printed circuit, in the same plane of tightening, allows a good compactness of the device according to the invention: the dimensions of the device are only slightly larger than those of the lamp base with which it cooperates. On the other hand, the printed circuit tightened in the plane of the clip against the lamp pin, undergoes no deformation capable of damaging it, when connected: the plane of tightening coincides with the direction of insertion of the printed circuit The means for positioning the pins, the means for retaining the circuit and the means for closing the clips have not been described in particular in FIGS. 6 et seq., it being understood that these means are the ones which have been described with reference to FIGS. 1 to 5, or are equivalent means known to the man skilled in the art.

What is claimed is:

1. A connection device for ensuring the mechanical and electrical connection of an automobile headlamp, comprising at least one flat connecting pin, with a flexible printed supply circuit, comprising, for each pin of the lamp to be connected, a clip constituted by two homologous parts connected by a hinge and adapted to cooperate with each other along a plane of tightening, these two homologous parts comprising on their inner face means for positioning the pin inside the clip, means for retaining the printed circuit inside the clip, means for closing the clip ensuring its tightening so that the printed circuit is applied along the whole length of the pin of the lamp.

2. The connection device of claim 1, wherein the means for retaining the printed circuit comprise male projecting parts cooperating with recesses made in the printed circuit.

3. The connection device of claim 1, wherein the means for positioning the pin comprise a recess adapted to receive the pin and a positioning lug adapted to pass through the standardised openings of the pin.

4. The connection device of claim 1, wherein the hinge of each clip is provided with an opening for the passage of a pin, so that, the clip being closed, the printed circuit and the pin extend substantially in the same plane coinciding with the plane of tightening.

5. The connection device of claim 1, wherein the means for positioning the lamp are adapted to a pin of a lamp of type H1 and the device comprises a single clip in one piece, made of plastics material.

6. The connection device of claim 1, wherein the means for closing the clip comprise on one of the parts thereof a shouldered catch and on the other part of the clip a homologous opening.

7. The connection device of claim 6, wherein said shouldered catch cooperates with a recess in the printed circuit to serve as retaining means therefor.

8. The connection device of claim 1, comprising a central body, generally cubic in shape, provided on three adjacent faces with flaps pivoting about hinges to constitute three clips, each of the three clips bearing the means for positioning a pin of a lamp of type H4 and means for retaining a section of printed circuit, as well as closure means.

9. The connection device of claim 8, wherein the cubic body is moulded flat as an assembly pivoted by hinges adapted to be reestablished in the form of a cube with the aid of a lid forming complementary face.

* * * * *